US007121488B1

(12) United States Patent
Marriott et al.

(10) Patent No.: US 7,121,488 B1
(45) Date of Patent: Oct. 17, 2006

(54) SPRING ASSIST ASSEMBLY FOR INFEED PAN OF WOOD CHIPPER

(75) Inventors: Mark Edward Marriott, Seven Hills (AU); Richard Steven Kennedy, Mt. Pleasant, MI (US)

(73) Assignee: Tramor, Inc., Remus, MI (US)

( * ) Notice: Subject to any disclaimer, the term of this patent is extended or adjusted under 35 U.S.C. 154(b) by 587 days.

(21) Appl. No.: 09/954,900

(22) Filed: Sep. 18, 2001

(51) Int. Cl.
*B02C 18/22* (2006.01)

(52) U.S. Cl. ..... 241/92; 241/285.3

(58) Field of Classification Search ..... 144/176, 144/250.25; 241/92, 285.2, 285.3; 16/306; 414/557, 558
See application file for complete search history.

(56) References Cited

U.S. PATENT DOCUMENTS 2,656,563 A * 10/1953 Jones ..... 16/327
3,069,101 A 12/1962 Wexell
3,076,489 A 2/1963 Schmidt et al.
3,182,917 A 5/1965 Tamny et al.
3,276,700 A 10/1966 Eklund
3,463,405 A 8/1969 Shepherd
3,559,724 A 2/1971 Wilkinson
3,635,410 A 1/1972 Smith
3,868,062 A 2/1975 Cunningham et al.
3,939,886 A 2/1976 Tucek
3,989,198 A 11/1976 Blasko
4,022,021 A 5/1977 Russell, Jr.
4,260,114 A 4/1981 Herder
4,452,400 A 6/1984 Williams
4,520,977 A * 6/1985 Holzhauser et al. ..... 248/201
4,560,110 A 12/1985 Burda
4,685,624 A 8/1987 Nidiffer et al.
4,687,179 A 8/1987 Smith
4,692,028 A 9/1987 Schave
4,716,823 A 1/1988 Capdevila
4,721,257 A 1/1988 Williams et al.
4,793,561 A 12/1988 Burda
4,836,736 A * 6/1989 Neagu ..... 414/557
4,906,486 A 3/1990 Young
4,961,539 A * 10/1990 Deem ..... 241/36
5,005,620 A 4/1991 Morey
5,018,672 A 5/1991 Peck et al.
5,088,532 A 2/1992 Eggers et al.
RE33,840 E 3/1992 Peterson et al.
5,167,374 A 12/1992 Strohmeyer
5,263,651 A 11/1993 Nadarajah
5,358,189 A 10/1994 Vandermolen
5,362,004 A 11/1994 Bateman
5,372,316 A 12/1994 Bateman
5,413,286 A 5/1995 Bateman
5,667,152 A 9/1997 Mooring
5,988,539 A 11/1999 Morey
6,000,642 A 12/1999 Morey (Continued)

FOREIGN PATENT DOCUMENTS

DE 36 24 996 A1 2/1988

(Continued)

*Primary Examiner*—Mark Rosenbaum
(74) *Attorney, Agent, or Firm*—Bliss McGlynn, P.C.

(57) ABSTRACT

An assist assembly for an infeed pan of a wood chipper includes at least one assist mount adapted to be connected to the wood chipper. The assist assembly also includes at least one assist member connected to the assist mount and adapted to operatively engage the infeed pan to assist an operator in handling a bulk weight of the infeed pan when the infeed pan is raised and lowered by the operator.

24 Claims, 2 Drawing Sheets

U.S. PATENT DOCUMENTS 6,016,855 A 1/2000 Morey
6,032,707 A 3/2000 Morey et al.

FOREIGN PATENT DOCUMENTS

DE 38 08 487 C1 5/1989

* cited by examiner

SPRING ASSIST ASSEMBLY FOR INFEED PAN OF WOOD CHIPPER

BACKGROUND OF THE INVENTION

1. Field of the Invention

The present invention relates generally to wood chippers and, more particularly, to an assist assembly for an infeed pan of a wood chipper.

2. Description of the Related Art

It is known to provide a wood chipper for chipping wood such as brush, branches, and the like to produce wood chips. An example of such a wood chipper is disclosed in U.S. Pat. No. 5,988,539 to Morey. In this patent, the wood chipper includes an infeed hopper, feed wheel assembly, and a cutting assembly having a rotatable disc with at least one knife or blade for chipping the wood entering the wood chipper and reducing it to wood chips. Typically, the wood chipper includes an infeed pan pivotally connected to the infeed hopper, which is raised and lowered by an operator to allow wood material to be placed on the infeed pan before entering the infeed hopper.

Although this infeed pan has worked well, it is heavy in weight, which makes it difficult for an operator to raise and lower the infeed pan. In addition, larger size wood chippers have heavier infeed pans, which may result in damage to the wood chipper if not raised and lowered smoothly. Therefore, it is desirable to assist an operator in raising and lower an infeed pan of a wood chipper.

SUMMARY OF THE INVENTION

Accordingly, the present invention is an assist assembly for an infeed pan of a wood chipper including at least one assist mount adapted to be connected to the wood chipper. The spring assist assembly also includes at least one assist member connected to the at least one assist mount and adapted to operatively engage the infeed pan to assist an operator in handling a bulk weight of the infeed pan when the infeed pan is raised and lowered by the operator.

One advantage of the present invention is that an assist assembly is provided for an infeed pan of a wood chipper. Another advantage of the present invention is that the assist assembly assists the operator in handling the bulk weight of the infeed pan when it is raised or lowered. Yet another advantage of the present invention is that the assist assembly may have one or more springs positioned to counter force the bulk weight of the infeed pan to raise and lower the infeed pan smoothly.

Other features and advantages of the present invention will be readily appreciated, as the same becomes better understood, after reading the subsequent description when taken in conjunction with the accompanying drawings.

DESCRIPTION OF THE PREFERRED EMBODIMENT(S)

Figure 1:
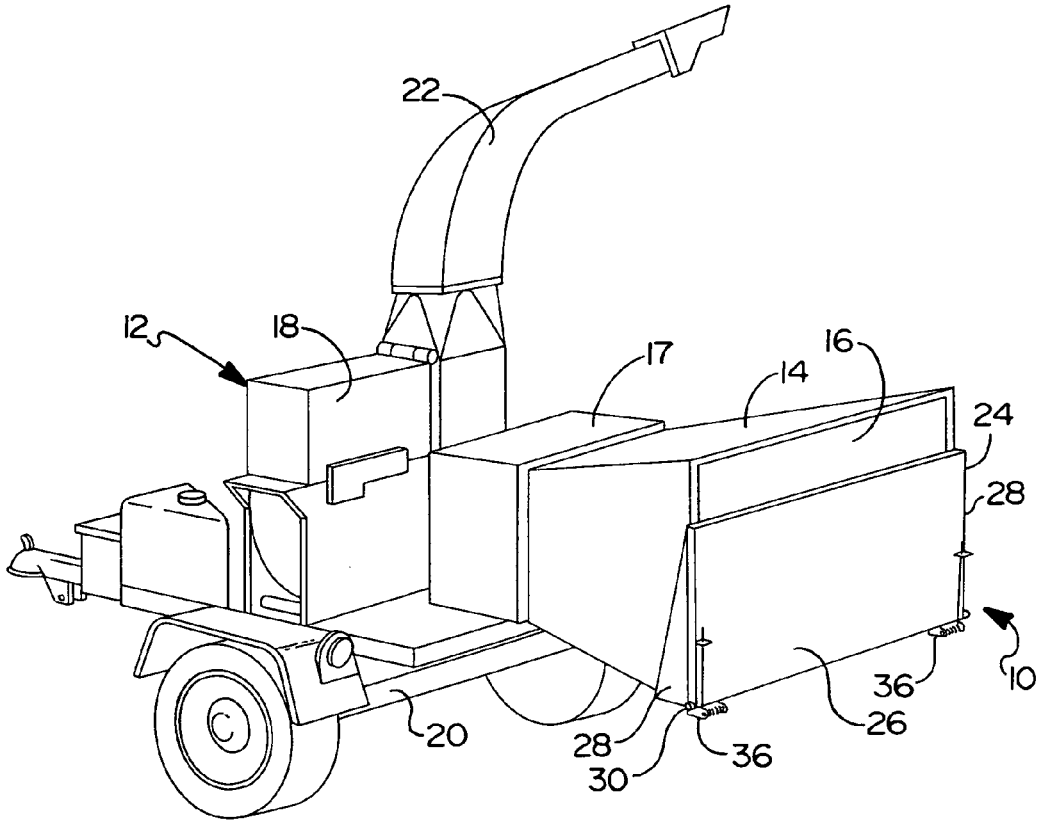
FIG. 1 is a perspective view of an assist assembly, according to the present invention, illustrated in operational relationship with a wood chipper.
Figure 2:
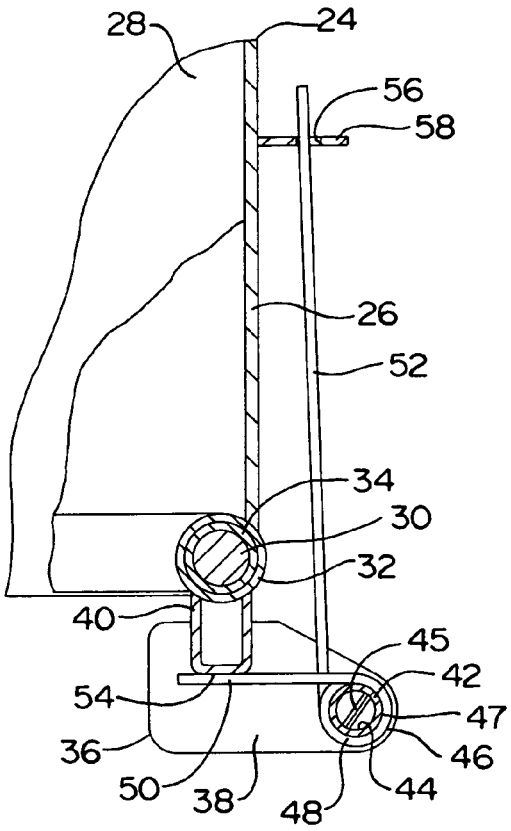
FIG. 2 is a fragmentary side elevational view of the assist assembly of FIG. 1 illustrating a first operative position.
Figure 3:
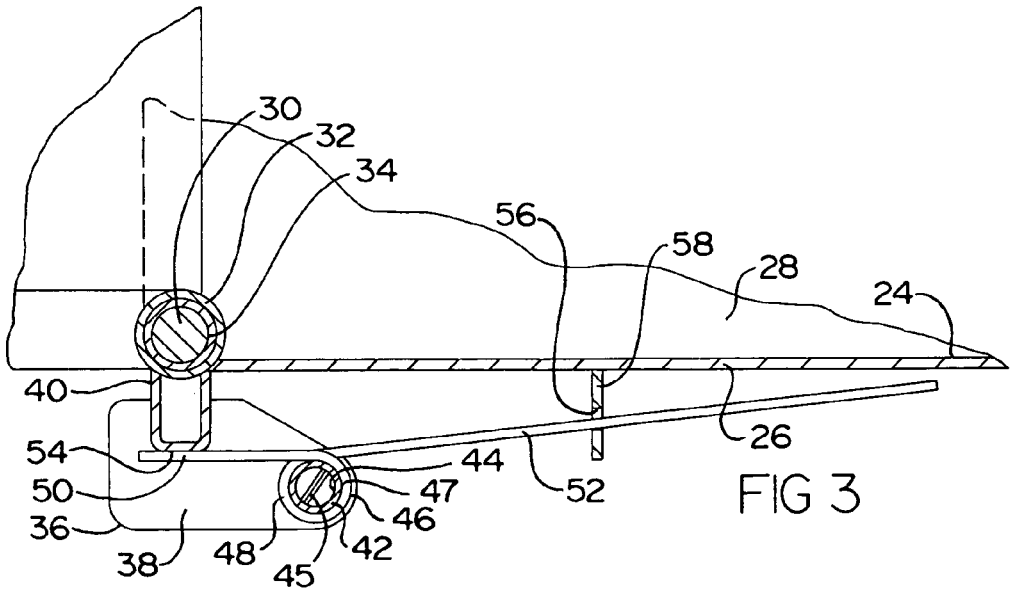
FIG. 3 is a view similar to FIG. 2 of the assist assembly illustrating a second operative position.

Referring now to the drawings and in particular FIGS. 1 through 3, one embodiment of an assist assembly 10, according to the present invention, is shown for a wood chipper, generally indicated at 12. The wood chipper 12 includes an infeed hopper assembly 14 having an inlet 16 to allow wood material to enter the wood chipper 12. The wood chipper 12 may include a feed wheel assembly 17 disposed between and adjacent to the infeed hopper assembly 14 and a cutting assembly 18 for rotation about a horizontal axis adjacent to the feed wheel assembly 17. The feed wheel assembly 17 is used for pulling and pushing the wood material from the infeed hopper assembly 14 to the cutting assembly 18. The cutting assembly 18 includes a rotatable disc or drum (not shown) having a plurality of blades (not shown) operatively connected to the disc or drum for chipping the wood material.

The wood chipper 12 also includes an engine (not shown) mounted on a frame 20 and coupled to the feed wheel assembly 17 and cutting assembly 18 by suitable means to cause rotation of the feed wheels and the disc or drum. The wood chipper 12 includes a rotatable shaft (not shown) operatively connected to the disc or drum of the cutting assembly 18 and a pulley (not shown) disposed about one end of the shaft. The wood chipper 12 further includes a rotatable shaft (not shown) operatively connected to the engine and a pulley (not shown) disposed about the shaft (not shown). The wood chipper 12 includes a belt or belts (not shown) disposed over and interconnecting the pulleys. It should be appreciated that the engine rotates the disc or drum of the cutting assembly 18 and a pump (not shown) may be included to pump hydraulic fluid to rotate the feed wheels of the feed wheel assembly 17.

The wood chipper 12 also includes an outlet or discharge chute 22 operatively connected to the cutting assembly 18. The discharge chute 22 is generally tubular and may be circular or rectangular in cross-sectional shape. The discharge chute 22 extends upwardly and away. It should be appreciated that the discharge chute 22 may have any suitable cross-sectional shape.

The wood chipper 12 further includes an infeed pan 24 disposed adjacent the inlet 16 of the infeed hopper assembly 14. The infeed pan 24 is generally rectangular in shape. The infeed pan 24 has a base wall 26 and a pair of opposed side walls 28 extending generally perpendicular to the base wall 26. The base wall 26 is generally rectangular in shape and the side walls 28 are generally triangular in shape. The infeed pan 24 is pivotally connected to the infeed hopper assembly 14 by suitable means such as a pin 30 extending laterally from each side wall 28 and disposed in a sleeve 32 extending laterally from each side of the infeed hopper assembly 14. A bushing 34 may be disposed between the pin 30 and sleeve 32. The infeed pan 24 is made of a metal material such as steel. The assist assembly 10 is used to assist the operator in handling the bulk weight of the infeed pan 24 when the infeed pan 24 is raised or lowered. It should be appreciated that, except for the assist assembly 10, the wood chipper 12 is conventional and known in the art.

Referring to FIGS. 1 through 3, the assist assembly 10 includes at least one, preferably a plurality of assist brackets or mounts 36 connected to the infeed hopper assembly 14 and spaced laterally along the inlet 16 thereof. Each assist mount 36 has at least one, preferably a pair of side members 38 spaced laterally along a lower member 40 of the infeed hopper assembly 14. The side members 38 are plates and made of a metal material such as steel. The lower member 40 may extend downwardly from the infeed hopper assembly 14 and the side members 38 may extend forwardly therefrom and are secured thereto by suitable means such as welding. Each assist mount 36 also has a support member 42 preferably extending laterally between the side members 38 and through corresponding apertures 44 in each of the side members 38 or from one side member 38. The support member 42 is a generally tubular member and made of a metal material such as steel. The support member 42 is prevented from exiting the apertures 44 by suitable means such as a cotter pin 45 extending through the support member 42 on the outer side of each of the side members 38. It should be appreciated that the support member 42 may rotate relative to the side members 38. It should also be appreciated that the assist mounts 36 may or may not be designed to allow adjustable spring tension, from a preload aspect.

The assist assembly 10 also includes at least one, preferably a plurality of assist members, generally indicated at 46, to counterforce the bulk weight of the infeed pan 24. The assist members 46 may of a type such as a spring, pneumatic damper, or gas-assisted cylinders. One of the assist members 46 is associated with one of the assist mounts 36. In one embodiment, the assist member 36 is a spring 47. Each spring 47 may be of a coil type having a plurality of turns or coils 48 and a first end 50 extending outwardly from one end of the coils 48 and a second end 52 extending outwardly from the other end of the coils 48. The second end 52 extends outwardly a greater distance than the first end 50. Preferably, each spring 47 is pre-formed into a general "L" shape. Each spring 47 has the coils 48 disposed about the support member 42 and the first end 50 engaging the lower member 40 of the wood chipper 12 and the second end 52 operatively engaging the infeed pan 24. The first end 50 engages or contacts a lower surface 54 of the lower member 40 such that the first end 50 is generally horizontal or parallel to the lower surface 54. The assist assembly 10 may includes a retainer 58 having an aperture 56 extending therethrough. The retainer 58 extends generally perpendicular from the base wall 26 of the infeed pan 24. The second end 52 of the spring 47 extends through the aperture 56 of the retainer 58 such that the second end 52 is spaced from the base wall 26 of the infeed pan 24. The retainer 58 is generally rectangular in shape. The retainer 58 is made of a metal material and secured to the infeed pan 24 by suitable means such as welding. The retainer 58 is located a sufficient distance upwardly along the base wall 26 of the infeed pan 24. It should be appreciated that the ends 50 and 52 of the spring 47 form a general "L" shape so that as the second end 52 is rotated away and relative to the first end 50, a counter force or pressure is formed to hold some of the weight of the infeed pan 24 and yet allow the infeed pan 24 to lower into an operating position. It should further be appreciated that the spring 47 may also be of a type such as a compression spring, extension pressure spring, or rotation pressure spring.

In operation, the assist assembly 10 and infeed pan 24 are in a first operative or upper stowed position as illustrated in FIGS. 1 and 2. An operator (not shown) grasps the infeed pan 24 and rotates the infeed pan 24 downwardly. As the infeed pan 24 is rotated downwardly, the second end 52 of the spring 47 moves farther away from the first end 50 and, since the first end 50 is stationary or fixed, the coils 48 generate a counterforce to hold some of the bulk weight of the infeed pan 24. The operator is assisted by the assist member 46 in handling the bulk weight of the infeed pan 24. The operator continues to rotate the infeed pan 24 to a second operative or lower operational position as illustrated in FIG. 3. When the engine of the wood chipper 10 is started, the engine rotates the cutting assembly 18 and may hydraulically rotate the feed wheels of the feed wheel assembly 17 if provided. Wood is fed onto the infeed pan 24 and into the inlet 16 of the infeed hopper assembly 14 by an operator and may be contacted by the feed wheels of the feed wheel assembly 17 if provided. The wood is fed by the feed wheels to the cutting assembly 18. As the cutting assembly 18 rotates and contacts the wood, the wood is cut or chipped into wood chips, which move through the outlet of the cutting assembly 18 and are expelled out of the discharge chute 22.

After the wood material is cut or chipped, the engine is stopped. The operator grasps the infeed pan 24 and rotates the infeed pan 24 upwardly. As the infeed pan 24 is rotated upwardly, the second end 52 of the spring 47 moves closer to the first end 50 and the coils 48 relax to reduce the counterforce on the infeed pan 24. The operator is assisted by the assist member 46 in handling the bulk weight of the infeed pan 24. The operator continues to rotate the infeed pan 24 to the upper stowed position as illustrated in FIGS. 1 and 2. It should further be appreciated that the assist assembly 10 may be located near either or both the left side and right side of the infeed hopper assembly 14 or at any position along the infeed hopper assembly 14. It should still further be appreciated that the assist assembly 10 can be used to retrofit exiting wood chippers or manufactured as original equipment on wood chippers.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A wood chipper comprising:

a movable infeed pan;

at least one assist mount connected to said wood chipper; and at least one assist member connected to said assist mount and to operatively engage said infeed pan to assist an operator in moving a bulk weight of said infeed pan when said infeed pan is raised to a generally vertical position and lowered to a generally horizontal position by the operator.

2. A wood chipper as set forth in claim 1 wherein said at least one assist member comprises a spring.

3. A wood chipper as set forth in claim 1 wherein said at least one assist mount comprises at least one side member extending from an infeed hopper assembly of said wood chipper.

4. A wood chipper as set forth in claim 1 wherein said at least one assist mount further comprises a support member extending from said at least one side member, said at least one assist member being connected to said at least one support member.

5. A wood chipper comprising:

a movable infeed pan;

at least one spring mount connected to said wood chipper; and at least one spring connected to said spring mount and to operatively engage said infeed pan to assist an operator in moving a bulk weight of said infeed pan when said infeed pan is raised to a generally vertical position and lowered to a generally horizontal position by the operator.

6. A wood chipper as set forth in claim 5 wherein said at least one spring is a coil spring.

7. A wood chipper as set forth in claim 5 wherein said at least one spring has a first end extending outwardly and a second end extending outwardly to form a general "L" shape.

8. A wood chipper as set forth in claim 7 wherein said at least one spring has a plurality of coils disposed between said first end and said second end.

9. A wood chipper as set forth in claim 7 wherein said second end is longer than said first end, said second end being adapted to operatively engage said infeed pan.

10. A wood chipper as set forth in claim 7 including a spring retainer connected to said infeed pan to space said second end from said infeed pan.

11. A wood chipper as set forth in claim 5 including a plurality of spring mounts spaced laterally and secured to an infeed hopper assembly of said wood chipper.

12. A wood chipper as set forth in claim 11 including a plurality of springs, one of said springs mounted to one of said spring mounts.

13. A wood chipper as set forth in claim 12 wherein one of said spring mounts and one of said springs is located adjacent said infeed pan.

14. A wood chipper as set forth in claim 5 wherein said at least one spring mount comprises at least one side member extending from an infeed hopper assembly of said wood chipper.

15. A wood chipper as set forth in claim 14 wherein said at least one spring mount further comprises a support member extending from said at least one side member.

16. A wood chipper as set forth in claim 15 wherein said support member is rotatably secured to said at least one side member.

17. A wood chipper comprising:

an infeed hopper;

an infeed pan pivotally connected to said infeed hopper;

at least one assist mount connected to said infeed hopper; and at least one assist member connected to said at least one assist mount and connected to said infeed pan and connected to said infeed hopper to assist an operator in moving a bulk weight of said infeed pan when said infeed pan is raised to a generally vertical position and lowered to a generally horizontal position by the operator.

18. A wood chipper as set forth in claim 17 wherein said at least one assist member comprises a spring.

19. A wood chipper as set forth in claim 18 wherein said at least one spring has a first end extending outwardly and a second end extending outwardly to form a general "L" shape.

20. A wood chipper as set forth in claim 19 wherein said at least one spring has a plurality of coils disposed between said first end and said second end.

21. A wood chipper as set forth in claim 17 wherein said at least one assist mount comprises at least one side member extending from said infeed hopper.

22. A wood chipper as set forth in claim 21 wherein said at least one assist mount further comprises a support member extending from said at least one side member.

23. A wood chipper as set forth in claim 22 wherein said support member is rotatably secured to said at least one side member.

24. A wood chipper comprising:

an infeed hopper;

a cutting assembly spaced from said infeed hopper;

a feed wheel assembly disposed between said infeed hopper and said cutting assembly to feed wood material from said infeed hopper to said cutting assembly;

an infeed pan pivotally connected to said infeed hopper;

at least one assist mount connected to said infeed hopper; and at least one assist member connected to said at least one assist mount and to operatively engage said infeed pan and to operatively engage said infeed hopper to assist an operator in moving a bulk weight of said infeed pan when said infeed pan is raised to a generally vertical position and lowered to a generally horizontal position by the operator.

* * * * *